US008312583B2

(12) United States Patent
van der Meijden et al.

(10) Patent No.: US 8,312,583 B2
(45) Date of Patent: Nov. 20, 2012

(54) SWIMMING POOL CLEANER DISCS WITH POCKETS

(75) Inventors: Hendrikus Johannes van der Meijden, Midrand (ZA); Michael Edward Moore, Johannesburg (ZA)

(73) Assignee: Zodiac Pool Systems, Inc., Vista, CA (US)

( * ) Notice: Subject to any disclaimer, the term of this patent is extended or adjusted under 35 U.S.C. 154(b) by 749 days.

(21) Appl. No.: 12/106,457

(22) Filed: Apr. 21, 2008

(65) Prior Publication Data

US 2008/0256727 A1 Oct. 23, 2008

Related U.S. Application Data

(60) Provisional application No. 60/925,764, filed on Apr. 23, 2007.

(51) Int. Cl.
*E04H 4/16* (2006.01)

(52) U.S. Cl. ..... 15/1.7; 15/246

(58) Field of Classification Search ..... 15/1.7, 15/236, 246; 137/843, 851
See application file for complete search history.

(56) References Cited

U.S. PATENT DOCUMENTS

| | | | | |
|---|---|---|---|---|
| 4,152,802 | A | 5/1979 | Chauvier | |
| 4,742,593 | A | 5/1988 | Kallenbach | |
| 4,949,419 | A | 8/1990 | Kallenbach | |
| 5,418,995 | A | 5/1995 | Rice et al. | |
| 5,421,054 | A * | 6/1995 | Dawson et al. | 15/246 |
| 5,433,985 | A | 7/1995 | Atkins | |
| 5,465,443 | A * | 11/1995 | Rice et al. | 15/246 |
| 5,617,606 | A | 4/1997 | Scott, II et al. | |
| 5,906,021 | A * | 5/1999 | Coffey | 15/1.7 |
| 6,122,794 | A | 9/2000 | Atkins | |
| 6,125,492 | A * | 10/2000 | Prowse | 15/1.7 |
| 6,248,232 | B1 * | 6/2001 | Stoner | 210/136 |
| 6,601,255 | B1 * | 8/2003 | van der Meyden et al. | 15/1.7 |
| 7,797,780 | B2 * | 9/2010 | Hui et al. | 15/1.7 |
| 2002/0166185 | A1 | 11/2002 | Balint | |
| 2007/0261183 | A1 | 11/2007 | Moore et al. | |

FOREIGN PATENT DOCUMENTS

WO WO-2008131322 A2 10/2008

* cited by examiner

*Primary Examiner* — Mark Spisich
*Assistant Examiner* — Michael Jennings
(74) *Attorney, Agent, or Firm* — Dean W. Russell; Kilpatrick Townsend & Stockton LLP

(57) ABSTRACT

Discs having recessed areas, or pockets, in their undersides are detailed. The pockets allow provision of increased suction in localized regions, especially useful when the body of an associated cleaner pivots from side to side. Downwardly-extending wear surfaces may be present as well within the pockets.

11 Claims, 6 Drawing Sheets

SWIMMING POOL CLEANER DISCS WITH POCKETS

REFERENCE TO PROVISIONAL APPLICATION

This application is based on and hereby refers to U.S. Provisional Patent Application Ser. No. 60/925,764, filed Apr. 23, 2007, and having the same title as appears above, the entire contents of which provisional patent application are incorporated herein by this reference.

FIELD OF THE INVENTION

This invention relates to discs and associated components of cleaners of liquid containing vessels and more particularly, although not necessarily exclusively, to automatic swimming pool cleaners having discs with pocketed undersides for enhanced localized suction.

BACKGROUND OF THE INVENTION

Commonly-owned U.S. Pat. No. 5,465,443 to Rice, et al., whose contents are incorporated herein in their entirety by this reference, describes various discs for, principally, automatic swimming pool cleaners. Extending upward from the upper surfaces of the discs are multiple fins. By contrast, except for a downwardly-projecting ramp positioned about a central aperture of the disc, its lower surface is generally planar.

U.S. Pat. No. 5,617,606 to Scott, II, et al., also commonly owned with this application, details other discs for automatic swimming pool cleaners. Projecting above the majority of the upper surfaces are one or more flutes, whose edges may be curved or straight as desired. Similarly projecting upward at the outer peripheries of the discs may be a raised, or upturned, lip.

Like the discs of the Rice patent, those of the Scott, II patent may include annular ramps projecting downwardly from their lower surfaces. Otherwise, however, the lower surfaces of the discs are generally flat, again similar to those of the discs of the Rice patent. The contents of the Scott, II patent are incorporated herein in their entirety by this reference.

SUMMARY OF THE INVENTION

The present invention provides alternatives to conventional discs, including those of the Rice and Scott, II patents. Unlike the generally flat lower surfaces of the discs of those patents, lower surfaces of the present discs contain one or more recessed areas intermediate their inner and outer peripheries. Such recessed areas, or pockets, are configured to provide increased suction in localized regions. They are especially (although not exclusively) useful with cleaners whose bodies pivot. See, e.g., U.S. patent application Ser. No. 11/708,925 of Moore, et al. (the "Moore Application"). The contents of the Moore Application are incorporated herein in their entirety by this reference.

Optionally included within any of the pockets may be one or more downwardly-extending elements or projections. These projections may, in effect, be unrecessed portions of the lower surface; alternatively, they may be recessed but to a lesser extent than the remainder of the pockets. In use, the projections function as contact, or wear, surfaces as the cleaners to which the discs are attached move throughout pools (or spas or other liquid-containing vessels).

Discs of the present invention may be similar to those of the Moore Application. In particular, the discs may comprise multiple parts. Alternatively, they may be molded as unitary structures, as are commercial versions of the discs of the Rice and Scott, II patents.

It thus is an optional, non-exclusive object of the present invention to provide novel discs for, principally, automatic swimming pool cleaners.

It is also an optional, non-exclusive object of the present invention to provide discs whose lower surfaces include means for locally increasing suction force.

It is a further optional, non-exclusive object of the present invention to provide discs having recessed areas of their lower surfaces for supplying localized increased suction.

It is another optional, non-exclusive object of the present invention to provide discs with wear members present within the recessed areas.

Other objects, features, and advantages of the present invention will be apparent to those skilled in the relevant art with reference to the remaining text and the drawings of this application.

DETAILED DESCRIPTION

Figure 1:
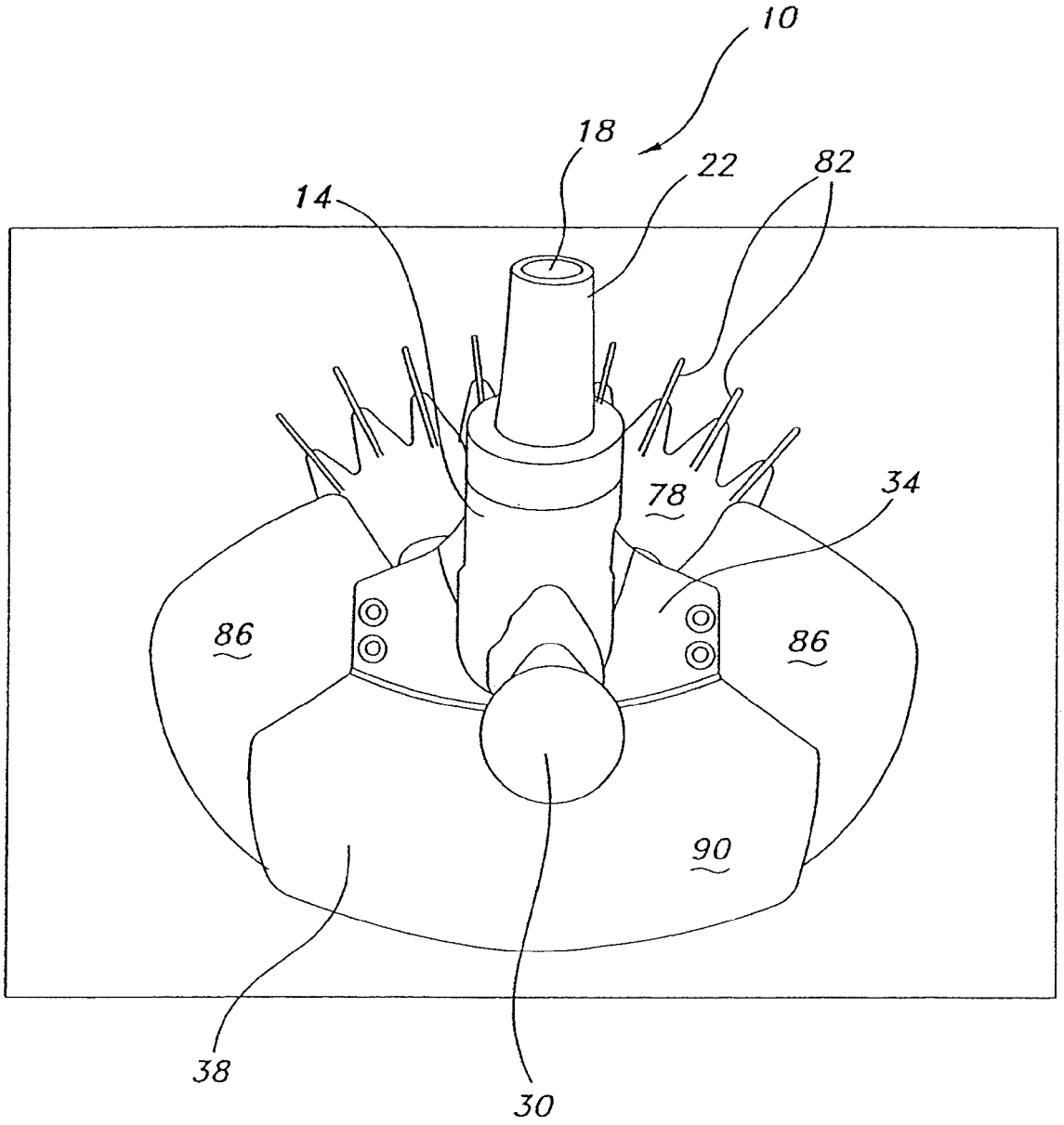
FIG. 1 is a generally bird's-eye view of an automatic swimming pool cleaner incorporating a disc consistent with the present invention.
Figure 2:
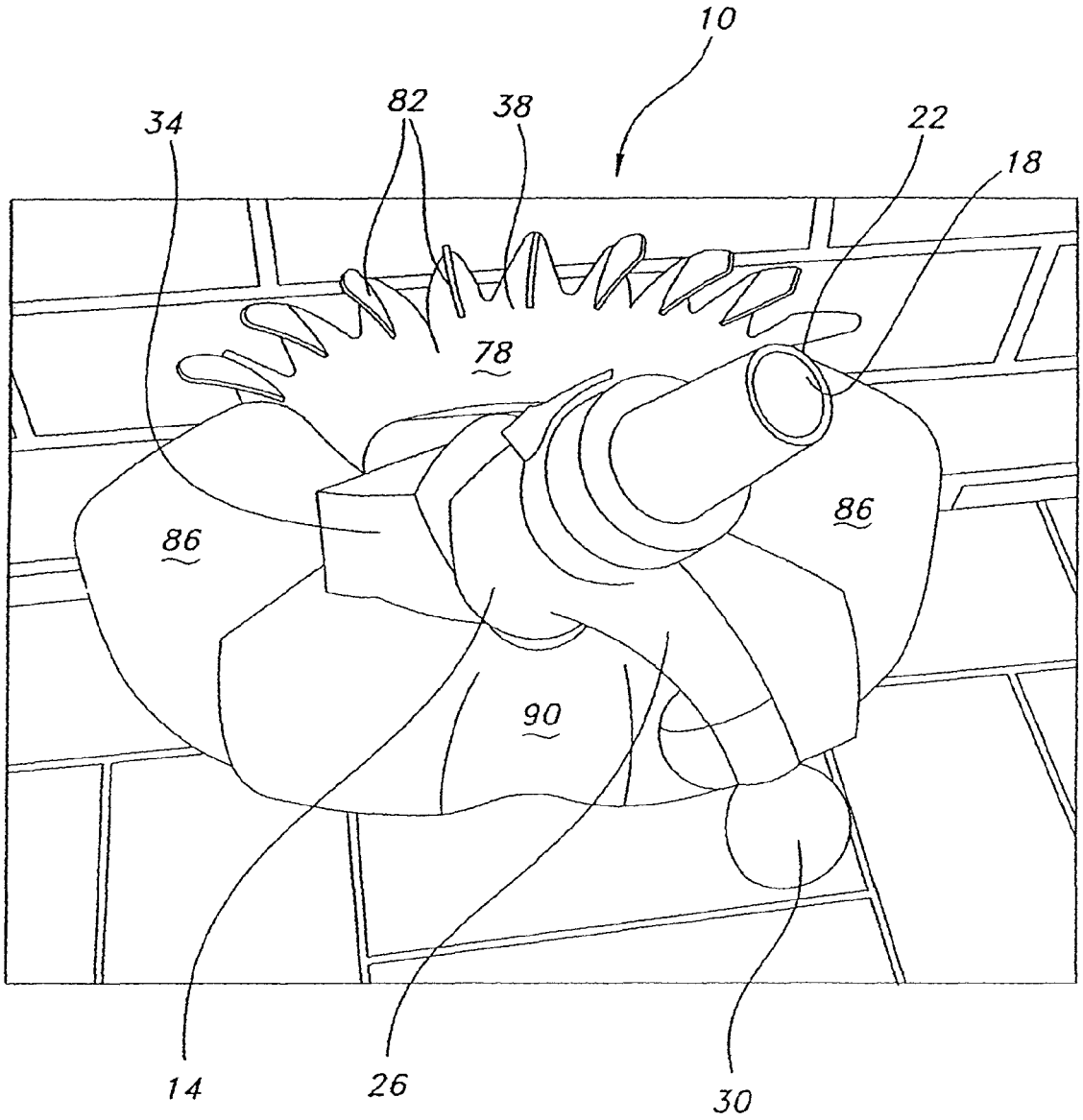
FIG. 2 is a perspective view of the automatic swimming pool cleaner of FIG. 1 illustrating the act of transitioning from a horizontal surface to a vertical surface of movement.

Depicted in FIGS. 1-2 is an exemplary automatic swimming pool cleaner 10 of the present invention. Cleaner 10 is designed primary for attachment to the inlet, or suction side, of a pump of a swimming pool filtration system. Some or all aspects of the present invention are not necessarily limited to use with suction-side automatic swimming pool cleaners, however, and conceivably could be employed as part of other devices as well.

Shown in FIGS. 1-2 as part of cleaner 10 are body 14, inner pipe 18, and outer pipe 22. Similar to those of the cleaner described in U.S. Pat. No. 4,742,593 to Kallenbach, inner and outer pipes 18 and 22 of cleaner 10 may be concentric, with outer pipe 22 adapted to be connected to a flexible hose leading, ultimately, to the inlet of a pump. Extending from body 14 may be arm 26, whose end 30 may contain a weight (not shown) functioning, in part, to balance a float (also not shown) typically positioned within body 14. However any weight need not necessarily be placed within end 30, and indeed need not necessarily be positioned at any point within arm 26. In use, aim 26 also may function as a bumper or bearing surface in certain situations.

Also illustrated in FIGS. 1-2 as part of cleaner 10 are apron 34 and disc 38. Apron 34 may be connected directly or indirectly to footpads 68, each of which may provide a bearing surface as cleaner 10 traverses a vessel; apron 34 may also serve as an interface connecting disc 38 to body 14. Although disc 38 too functions, to modest extent, as a bearing surface, it also operates to effect sealing of certain surfaces as body 10 is evacuated by the pump.

FIGS. 1-6 detail aspects of (nominal) underside 42 of body 14. Visible in underside 42 is inlet 46, through which debris-laden water or other fluid may flow into cleaner 10. In normal use, inlet 46 is adjacent a to-be-cleaned pool surface. Also illustrated in FIG. 6 within inlet 46 is inlet end 50 of valve 54, through which the debris-laded fluid passes before travelling through inner pipe 18 to the flexible hose and, from there, to some type of filter.

Valve 54 accordingly is "in-line," in that it forms part of this main fluid-flow path through body 14. Any suitable valving mechanism may be employed as valve 54. Preferably, however, valve 54 is of the diaphragm type, as depicted in the Kallenbach patent. Other aspects of disc 38 also are detailed in FIGS. 1-6. Disc 38 may be formed of moldable plastic or other material. Preferably, however, disc 38 lacks uniform flexibility. Instead, disc 38 has lesser flexibility forward of body 14 of automatic swimming pool cleaner 10 and greater flexibility elsewhere.

As depicted in FIGS. 1-6, forward section 78 of disc 38 may, but need not necessarily, constitute an arc-shaped segment of material similar to that described in U.S. Pat. No. 5,421,054 to Dawson, et al., whose contents also are incorporated herein in their entirety by this reference. As initially noted therein, fins 82 may extend radially upward from and outward of a serpentine periphery, with the fins 82 providing sufficient rigidity to disc 38 to enable it to ride over various objects, including many drains, lights, valves, and other nozzles, projecting from internal surfaces of pools. Enhanced rigidity of forward section 78 additionally inhibits its assuming the shape or a corner or other transition within a pool (and thereby sticking in the corner or at the transition) and prevents forward section 78 from folding under itself when departing from vertical surfaces such as walls.

Connected to any, some, or all of forward section 78, apron 34, footpad 68, or body 14 are mid-section 86 and rear section 90 of disc 38. Contrasted with forward section 78, mid-section 86 and rear section 90 are more flexible, as they rarely function as the leading edge of cleaner 10. This greater flexibility provides improved sealing of disc 38 to the surface to be cleaned. Flexibility of rear section 90 additionally may improve the ability of cleaner 10 to climb pool walls by permitting body 14 to rotate rearward some as generally illustrated in FIG. 2.

Figure 3:
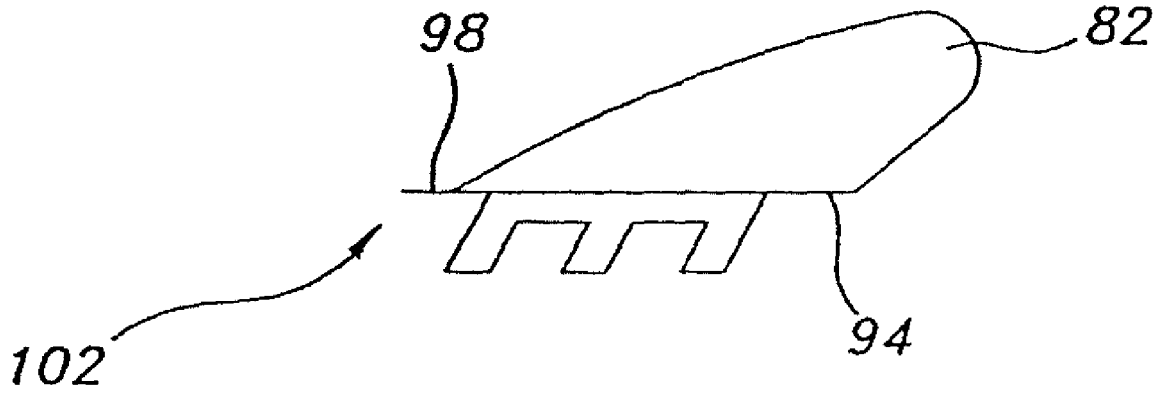
FIG. 3 illustrates, somewhat schematically, barbed gripping material attached to the underside of portions of a disc consistent with the present invention.
Figure 4:
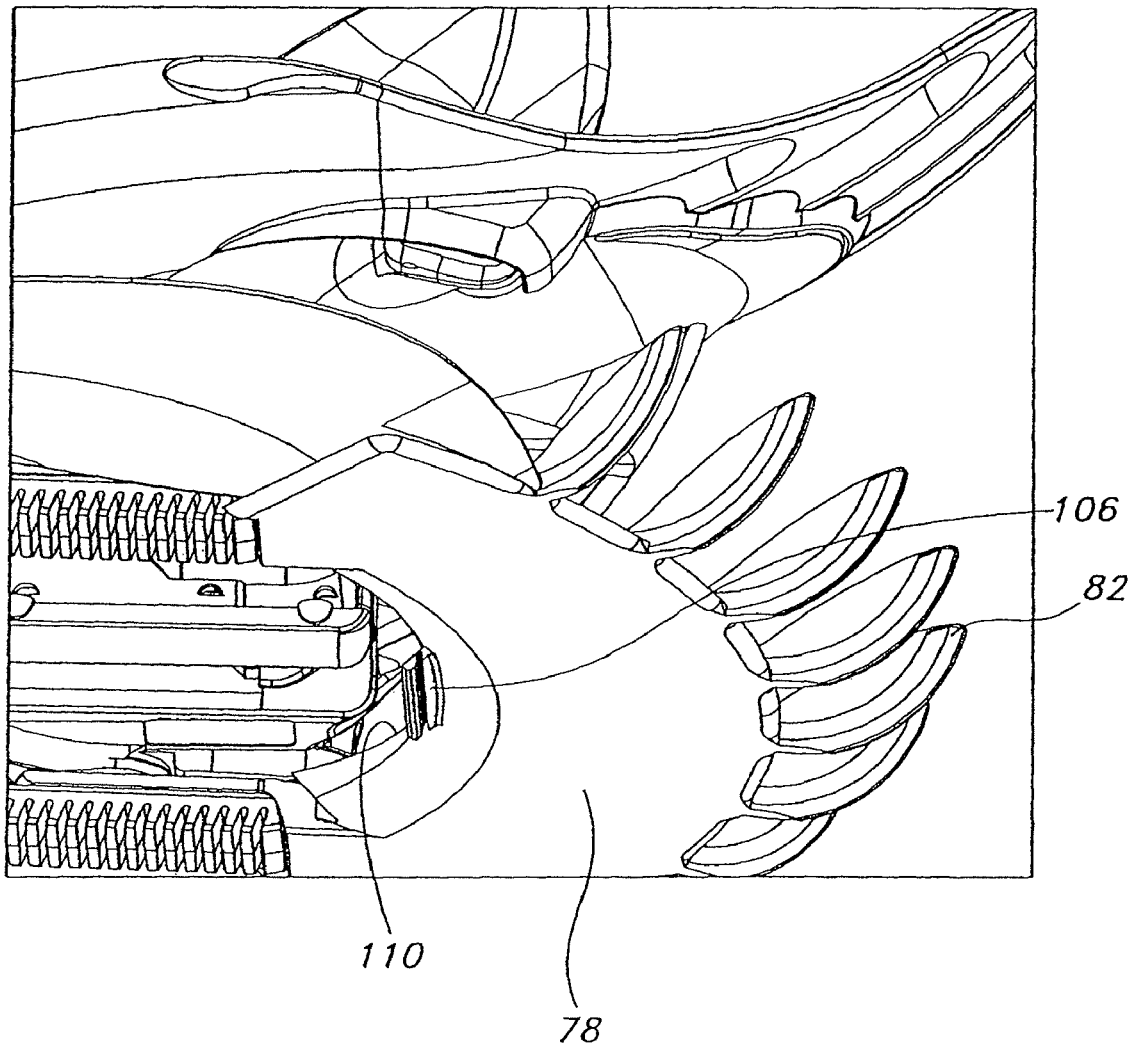
FIG. 4 shows aspects of an alternate automatic swimming pool cleaner of the present invention.

Because of float placement within some versions of cleaners 10, the center of gravity of such cleaners 10 is forward of fins 82. Consequently, when a swimming pool pump is inactive, inner and outer pipes 18 and 22 tend to rest at a low angle to the horizontal, effectively causing cleaner 10 to "lie down." When the pump is activated, cleaner 10 may attempt to travel backward, undesirably, rather than forward. Accordingly, undersides 94 of tongues 98 from which fins 82 protrude may include barbed gripping material 102 as shown in FIG. 3. Such material is configured to inhibit backward movement of cleaner 10 in these circumstances, thereby encouraging desired forward movement thereof.

Alternatively or additionally, one or more tabs 106 may be attached to or integrally formed with forward section 78 of disc 38. Shown in FIG. 4, an exemplary tab 106 is adapted to lie flat when cleaner 10 is moving forward so as not to impede such movement. However, should cleaner 10 attempt to travel backward in use, tab 106 will contact (catch) the floor of the pool, in turn forcing forward section 78 upward. As forward section 78 moves upward, rear section 90 will be forced downward, allowing it to adhere to the pool surface temporarily and cease the backward movement. One tab 106 preferably is positioned at rear edge 110 of forward section 78 (opposite fins 82), although more tabs 106 may be used and positioned otherwise as needed.

Figure 5:
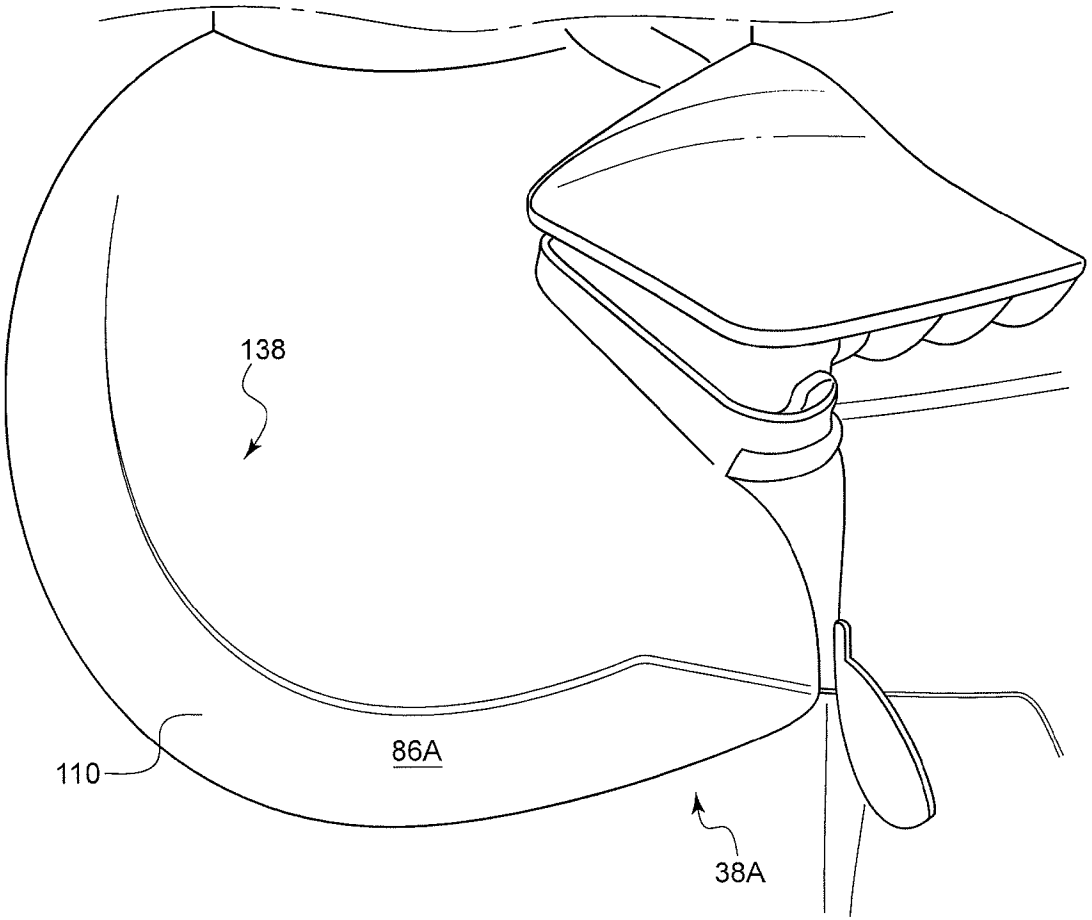
FIG. 5 illustrates portions of upper surfaces of a disc similar to that of FIG. 1.
Figure 6:
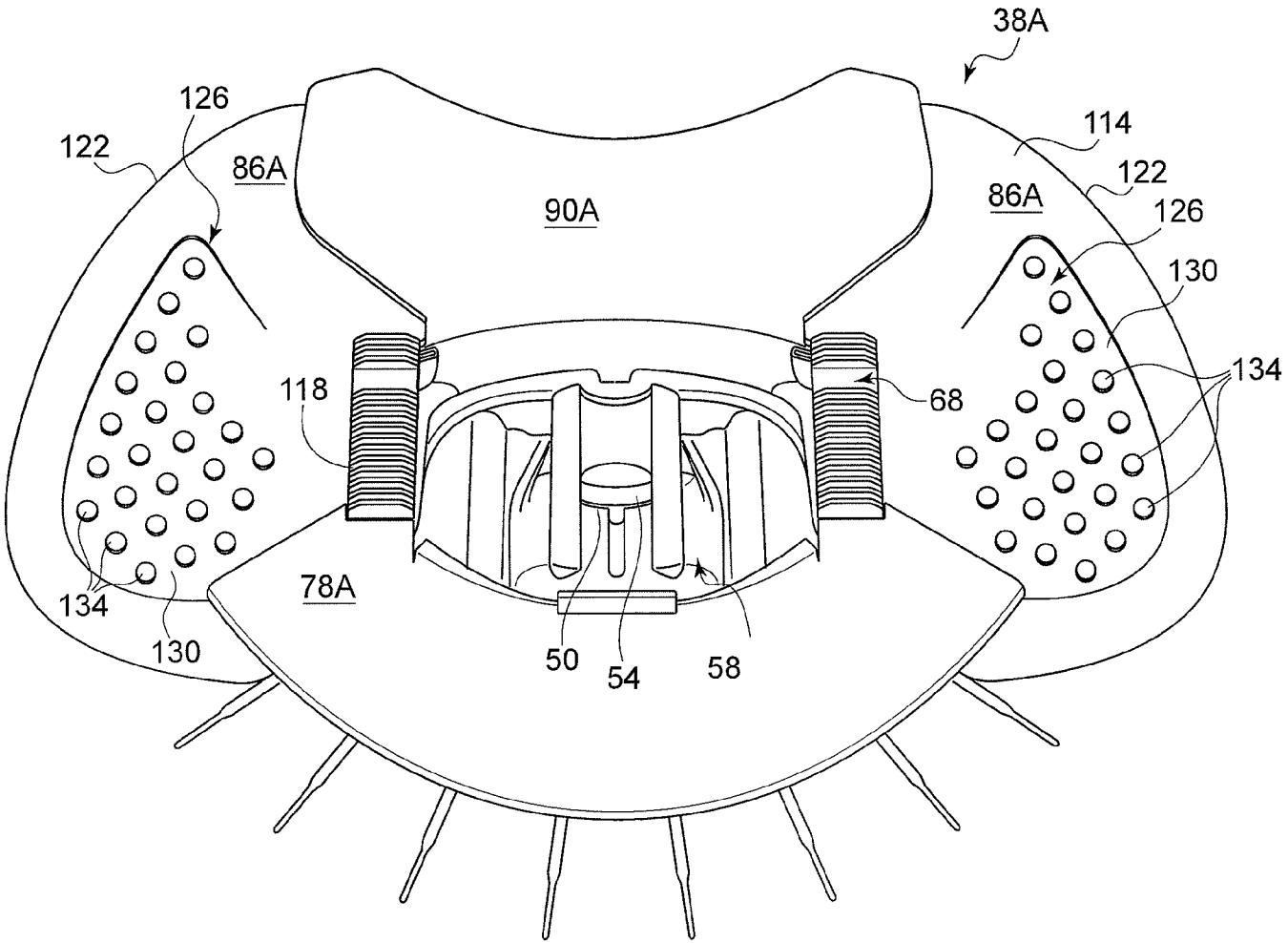
FIG. 6 illustrates portions of lower surfaces of the disc of FIG. 5.

Detailed in FIGS. 5-6 is an improved version of disc 38. Disc 38A, like disc 38, may include forward section 78A, mid-section 86A, and rear section 90A. Again similar to the manner in which disc 38 is assembled, mid-section 86A and rear section 90A may be connected to any or all of forward section 78A, apron 34, footpad 68, or body 14.

Defined by at least mid-section 86A are upper surface 110 and lower surface 114. As illustrated in FIG. 6, formed in lower surface 114 generally between inner periphery 118 and outer periphery 122 is recessed area 126. Such recessed area 126 thus is configured substantially as a pocket, with the area 126 capable of being (at least partially) evacuated during operation of cleaner 10. Recessed area 126 may beneficially extend to outer periphery 122 in some embodiments of disc 38A, with such extension shown in FIG. 6 where mid-section 86A overlaps forward section 78A. Likewise, in certain circumstances, recessed area 126 may extend to or near inner periphery 118.

Projecting (nominally downwardly when cleaner 10 is upright) from roof 130 of recessed area 126 may be one or more elements 134. Elements 134, if present, may span the depth of recessed area 126. Elements 134 thus are configured to contact a to-be-cleaned surface when unrecessed portion 138 of lower surface 114 does, providing wear surfaces for recessed area 126. Should such elements 134 not be present, risk of frictional wear of roof 130 exists.

Presently-preferred versions of elements 134 are shaped as cylinders, with multiple such elements 134 molded as part of disc 38A and spaced within recessed area 126. Elements 134 need not be shaped as cylinders, however. Indeed, elements 134 are optional and need not be shaped in any particular way or necessarily present.

FIG. 6 illustrates two recessed areas 126, one to each side of valve 54. If valve 54 is designed to move periodically, valve assembly 58 may reposition inlet end 50 from side to side, periodically reorienting inlet end 50 toward one or the other of the recessed areas 126. Providing the recessed area 126 as suction force is applied via valve 54 facilitates the corresponding mid-section 86A adhering to the to-be-cleaned surface, supplying a region adapted for evacuation. However, recessed areas 126 may be useful regardless of whether valve 54 is fixed or moveable and with valves other than valve 54. FIG. 5, finally, shows raised area 138 of upper surface 110 corresponding to recessed area 126.

The foregoing is provided for purposes of illustrating, explaining, and describing embodiments of the present invention. Modifications and adaptations to these embodiments will be apparent to those skilled in the art and may be made without departing from the scope or spirit of the invention.

What is claimed is:

1. An automatic swimming pool cleaner comprising:

a. a body;

b. an inner pipe having at least a portion positioned within the body; and c. a disc (i) connected directly or indirectly to the body so as to contact in use a surface to be cleaned and (ii) having an outer boundary, at least a first portion of the disc being flexible and having an underside with a recessed area therein forming in use an at least partially evacuatable region configured to effect at least partial sealing against the surface to be cleaned, a first part of the recessed area not extending to the outer boundary and a second part of the recessed area extending to the outer boundary.

2. An automatic swimming pool cleaner according to claim 1 in which a second portion of the disc has an underside with a recessed area therein configured to form an evacuatable region.

3. An automatic swimming pool cleaner according to claim 2 in which the recessed areas of the respective first and second portions of the disc are separated by a third portion of the disc having an underside lacking a recessed area.

4. An automatic swimming pool cleaner according to claim 3 in which (i) the first, second, and third portions of the disc are a mid-section and (ii) the disc further comprises a forward section and a rear section.

5. An automatic swimming pool cleaner according to claim 4 in which at least a portion of the mid-section overlaps the forward section.

6. An automatic swimming pool cleaner according to claim 1 in which the disc extends externally of both the inner pipe and the body.

7. An automatic swimming pool cleaner comprising:

a. a body; and b. a disc (i) connected directly or indirectly to the body so as to contact in use a surface to be cleaned and (ii) having an outer boundary, at least a first portion of the disc being flexible and having an underside with a recessed area therein forming in use an at least partially evacuatable region configured to effect at least partial sealing against the surface to be cleaned, at least a first part of the recessed area not extending to the outer boundary, and in which the recessed area is bounded by a roof and the disc comprises at least one projection extending from the roof into the recessed area.

8. An automatic swimming pool cleaner according to claim 7 in which, in use, the projection contacts the surface to be cleaned.

9. An automatic swimming pool cleaner comprising:

a. a body; and b. a disc (i) connected directly or indirectly to the body so as to contact in use a surface to be cleaned, (ii) having an outer boundary, at least a first portion of the disc being flexible and having an underside with a recessed area therein forming in use an at least partially evacuatable region configured to effect at least partial sealing against the surface to be cleaned, at least a first part of the recessed area not extending to the outer boundary, and (iii) comprising a forward section and a rear section, the forward section having a generally planar area and comprising at least one protrusion extending upward from the generally planar area.

10. An automatic swimming pool cleaner according to claim 9 in which the generally planar area of the forward section also has a periphery beyond which the protrusion extends.

11. An automatic swimming pool cleaner comprising:

a. a body; and b. a disc connected directly or indirectly to the body so as to contact in use a surface to be cleaned, the disc comprising:

i. a forward section;

ii. at least one protrusion extending upward from the forward section;

iii. a rear section; and iv. a flexible mid-section overlapping the forward section, the mid-section comprising:

A. an inner boundary;

B. an outer boundary;

C. an underside having a recessed area between the inner and outer boundaries forming in use an at least partially evacuatable pocket configured to effect at least partial sealing against the surface to be cleaned; and D. at least one projection extending into the recessed area, which projection in use contacts the surface to be cleaned.

* * * * *